US012024351B1

(12) United States Patent
Critchfield

(10) Patent No.: US 12,024,351 B1
(45) Date of Patent: Jul. 2, 2024

(54) SCENTED DICE CONTAINER

(71) Applicant: Arthur Brent Critchfield, Cedar Park, TX (US)

(72) Inventor: Arthur Brent Critchfield, Cedar Park, TX (US)

( * ) Notice: Subject to any disclaimer, the term of this patent is extended or adjusted under 35 U.S.C. 154(b) by 0 days.

(21) Appl. No.: 17/678,296

(22) Filed: Feb. 23, 2022

(51) Int. Cl.
*B65D 81/18* (2006.01)
*A63F 3/00* (2006.01)
*B65D 25/10* (2006.01)

(52) U.S. Cl.
CPC ..... *B65D 81/18* (2013.01); *A63F 3/00895* (2013.01); *B65D 25/108* (2013.01); *A63F 2003/00949* (2013.01)

(58) Field of Classification Search
CPC ..... A61L 9/032; A61L 9/122; A61L 9/127; A61L 2209/133; A63F 9/04; A63F 9/0413; A63F 9/0415; A63F 2009/0486
USPC ..... 96/222; 206/205–213.1; 261/142; 273/146
See application file for complete search history.

(56) References Cited

U.S. PATENT DOCUMENTS 9,022,365 B2 * 5/2015 Brosmith ..... A61L 9/122 261/142
2006/0043215 A1 * 3/2006 Evans ..... A61L 9/122 239/289

FOREIGN PATENT DOCUMENTS

CN 202819895 U * 3/2013

* cited by examiner

*Primary Examiner* — Bryon P Gehman
(74) *Attorney, Agent, or Firm* — Hanrahan Law Firm, P.A.; Benjamin M. Hanrahan

(57) ABSTRACT

A fragrance infusing dice container and a method of infusing dice with a fragrance are disclosed herein. In particular, the container includes an enclosure defining an interior area within which a fragrance diffuser is disposed. A dice holder is also disposed within the enclosure with a plurality of dice retention openings sized to receive dice therein. The dice holder, and in particular, the dice retained thereby are fluidically arranged with the fragrance diffuser such that application of a scented oil to at least a portion of the fragrance diffuser causes the scented oil to at least partially diffuse and permeate within the enclosure and impart upon the dice.

15 Claims, 9 Drawing Sheets

SCENTED DICE CONTAINER

FIELD OF THE INVENTION

The present invention is generally directed to a dice container, and more specifically, to a container that not only stores or otherwise retains one or more dice, but also imparts, infuses or applies a fragrance, aroma or scent to the dice via a fragrance diffuser disposed therein.

BACKGROUND OF THE INVENTION

Dice, as used herein, are common multi-sided throwable objects generally with markings or indicia disposed on one or more of the sides which can be used to play various games. In particular, depending on the game played, the dice may be four-sided, six-sided, eight-sided, ten-sided, twelve-sided, twenty-sided, etc., and may include numbered indicia, dots, symbols, graphics, logos, colors, etc. disposed or displayed on the various sides thereof.

It may be desirable, in some instances, to store dice or other game pieces, for example, when the game pieces are not being used or when the game is not being played. In this manner, basic storage containers for dice and/or other game pieces are well known.

It may also be desirable to infuse or impart a calming, energetic or other scent or fragrance to the dice or other game piece, for example, but not necessarily limited to, prior to playing a game with the dice or other game pieces. The scent or fragrance may provide an additional element or sensory aspect to the game, while in other cases, the scent or fragrance may simply be a desire or appeal to the users or players thereof.

Accordingly, there is a need in the art for a storage or other container that can be used to not only store various items, including, but not limited to one or more dice, game piece(s), jewelry, and/or other item(s), as well as a combination thereof, but can also be used to impart, apply or infuse a selected or desired fragrance to the one or more items while being stored within the container. In this manner, when the dice or other items are removed from the container, for example, in order to be used during the furtherance of a game, the dice or other items exhibit a pleasing, calming, energetic or other fragrance.

SUMMARY OF THE INVENTION

Accordingly, at least one embodiment of the present invention is directed to a container or enclosure that includes one or more fragrance diffusers that can be used to apply or infuse a selected, desired or other fragrance to the dice or other items stored or retained therein.

More specifically, a fragrance diffuser, including but not limited to an evaporative fragrance diffuser, may be disposed within an enclosure, such as a tight-closing box or other like container. In some embodiments, the fragrance diffuser includes a pad, plate or other air permeable, fibrous or porous membrane which may be secured, for example, via an adhesive layer, to the inside of the enclosure. The fragrance diffuser can be manufactured or made of, but is certainly not limited to, polyester, wool, cellulose fiber, natural fiber, or any other fibrous or non-fibrous material that is capable of receiving, at least partially absorbing, and/or otherwise diffusing the fragrance source (e.g., an essential oil, scented oil, etc.) and operate in the intended manner, as described herein.

Furthermore, a dice holder is also disposed or disposable within the interior portion of the enclosure, and which includes a plurality of dice retention portions, holes, recesses or openings that are each sized to at least partially receive a die or a plurality of dice therein. In particular, each of the dice retention portions or openings are arranged or positioned within the enclosure relative to the fragrance diffuser in a manner such when a fragrance source, such as but not limited to a scented oil or an essential oil, is applied to a portion of the fragrance diffuser, the scented oil (or other fragrance source) will at least partially evaporate and/or diffuse through the fragrance diffuser and/or within the enclosure. This will then cause the scented oil (e.g., the at least partially evaporated or vaporized oil) to flow to the dice retention portions or openings where the one or more dice are stored, thereby infusing or applying the fragrance to the dice.

Additionally, in at least one embodiment, the fragrance diffuser includes a designated application portion disposed or otherwise defined on one end thereof to which the scented oil, or other fragrance source, is applied. Specifically, in at least one embodiment, the application portion is offset from, not aligned with, and therefore not in direct contact with the dice retention portions or the one or more dice stored therein. In this manner, when applied to the fragrance diffuser, the oil does not come in direct contact with the dice, except through the diffusion and/or evaporation thereof, thereby minimizing or preventing the dice from becoming oily in the process.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
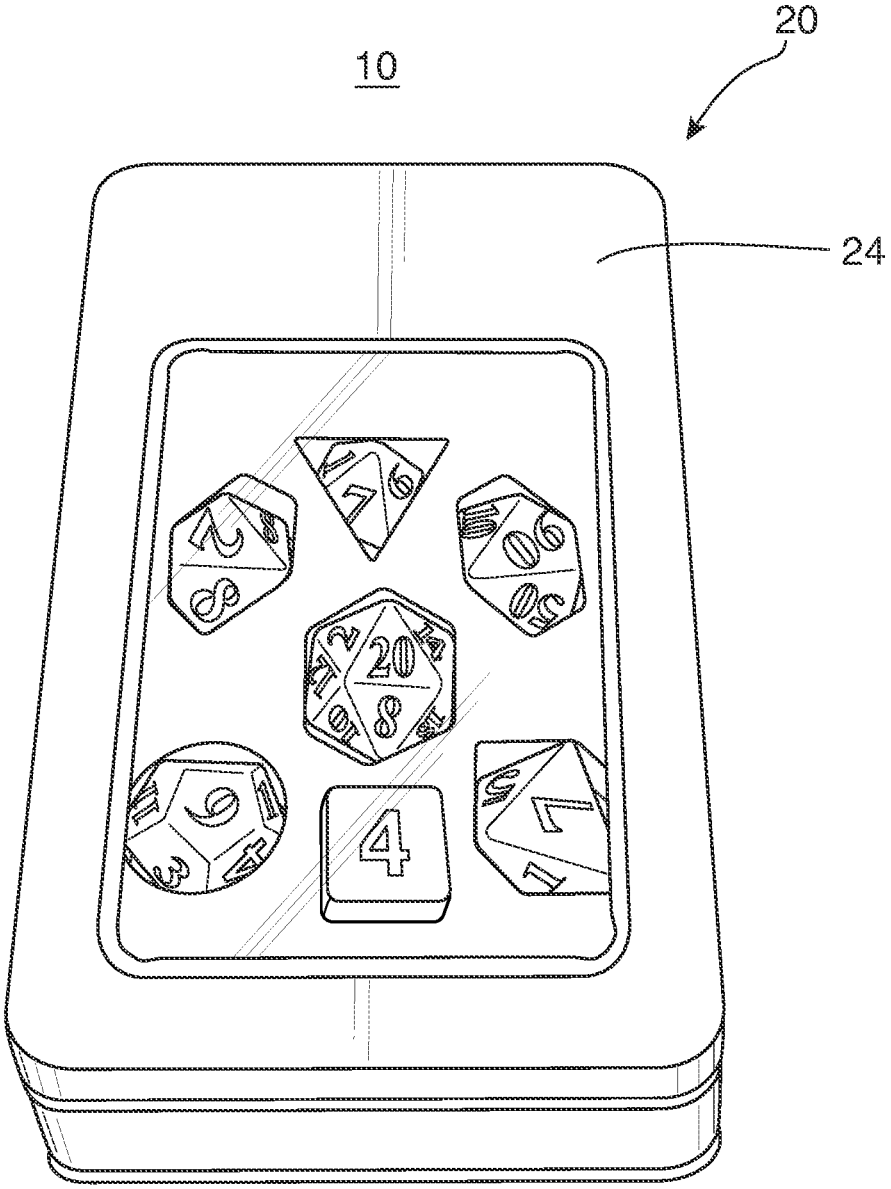
FIG. 1 is a top perspective view of the container in a closed position as disclosed in accordance with at least one embodiment of the present invention.
Figure 2:
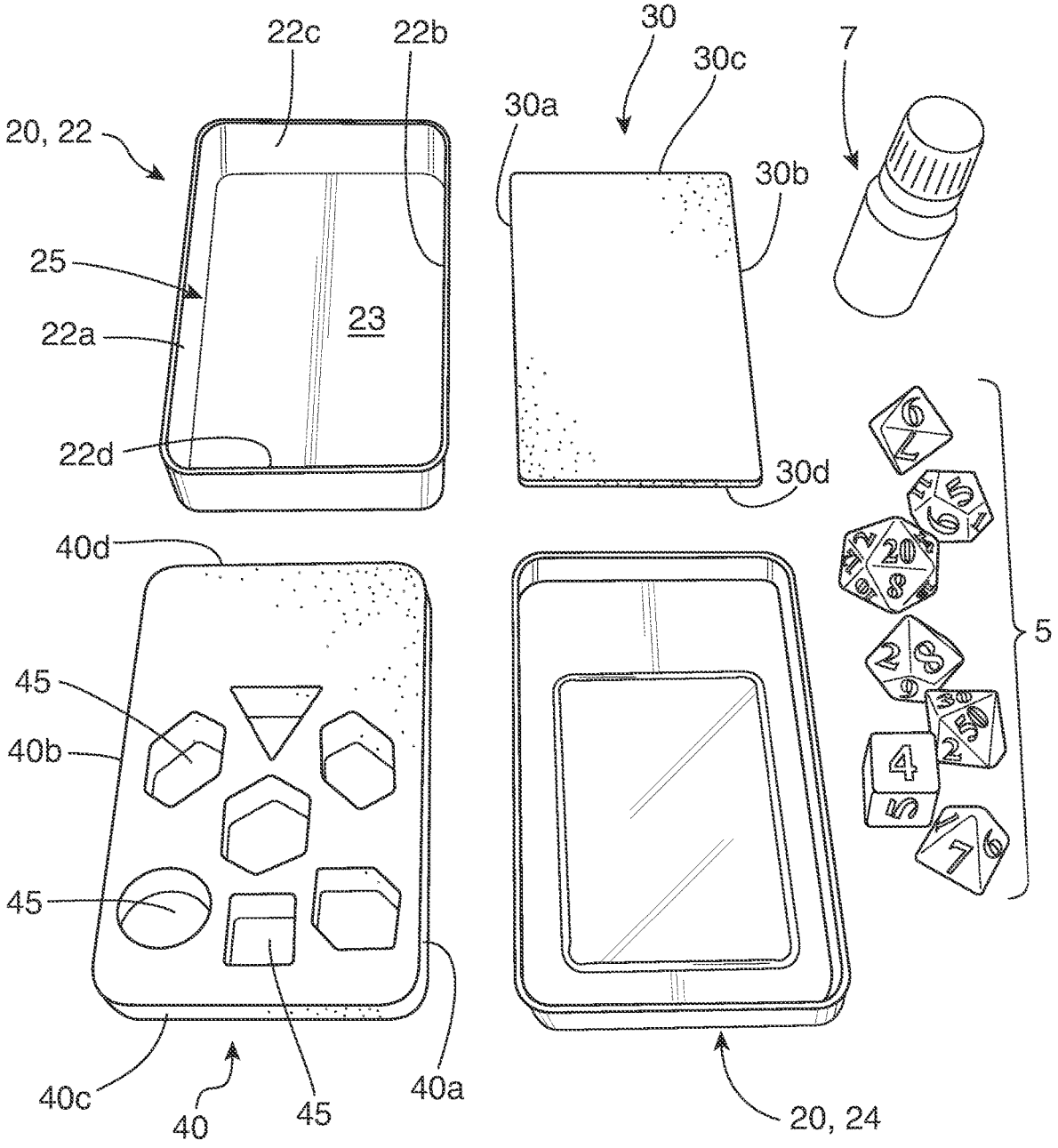
FIG. 2 is a separated view of the components of the container as disclosed in accordance with at least one embodiment of the present invention, along with exemplary dice and an exemplary bottle of scented oil.
Figure 3:
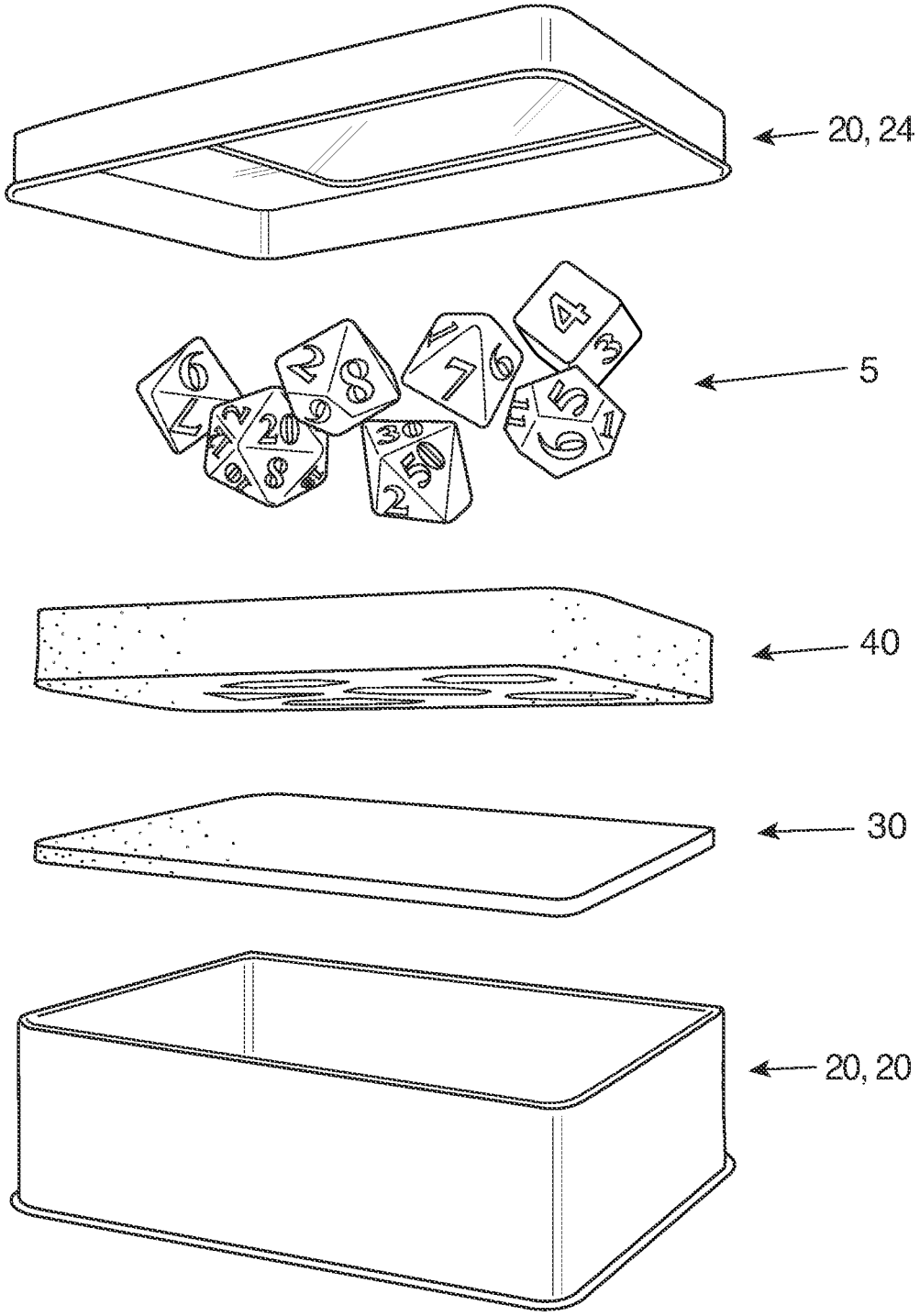
FIG. 3 is an exploded view of the container as disclosed in accordance with at least one embodiment of the present invention, along with exemplary dice.

As shown in the accompanying drawings, and with particular reference to FIGS. 1, 2 and 3, the present invention is directed to a fragrance infusing dice container, generally represented as 10. Specifically, as described herein, the container 10 of at least one embodiment of the present invention is structured and configured to impart, apply or infuse a fragrance, scent or aroma to one or more dice 5 (or other item(s)) stored or retained therein. In this manner, while the dice 5 is/are stored or retained within the container 10 of at least one embodiment, a fragrance diffuser, generally referenced as 30, to which an aroma or fragrance source (e.g., a scented oil, essential oil, scented liquid, etc.) is applied, will release or diffuse an aroma or fragrance, which will then be imparted, applied or infused to the one or more dice 5.

More specifically, FIGS. 2 and 3 illustrate the various components of the container 10 of at least one embodiment of the present invention, as well as exemplary dice 5 and an exemplary fragrance source 7 (shown in FIG. 2) in the form of a scented oil. As provided herein, the fragrance source 7, such as an essential oil or scented oil, may have or may otherwise release a distinct aroma or fragrance, such as, but in no way limited to lavender, sandalwood, rose, chamomile, jasmine, lemon, etc. It should be noted that the fragrance source 7 may be in the form of a scented oil or an essential oil, as provided herein, however, other forms or fragrance sources are contemplated within the full spirit and scope of the present invention including fragrance oils, fragrance liquids, scented liquids, infused solids or botanicals, dry botanicals, etc.

Furthermore, the dice 5, as used herein, refers to a common multi-sided throwable object generally with markings or indicia disposed on one or more of the sides which can be used to play various games. In particular, depending on the game played, the dice may be four-sided, six-sided, eight-sided, ten-sided, twelve-sided, twenty-sided, etc. and may include numbered indicia, dots, symbols, graphics, logos, colors, etc. disposed or displayed on at least one, but more commonly on a plurality of or all of the various sides thereof. In some embodiments, the dice 5 may be constructed or made of a material, including but in no way limited to acrylic, that allows the dice to pick up or at least temporarily retain the fragrance or aroma imparted thereupon via the present invention. However, it should be noted that the dice may be constructed or made of virtually any material, such as, but in no way limited to, resin, stone, semi-precious stone, precious stone, aluminum, heavy metal, wood, bone, etc.

Furthermore, unless the context otherwise clearly indicates, the term "dice" is used herein to indicate both the singular (e.g., one die) and the plural (e.g., more than one dice) forms.

Moreover, the container 10 of certain embodiments of the present invention may be used to store or retain other items (in addition to or instead of dice) including, for example, game pieces, e.g., figurines, tiles, chips (e.g., poker-style chips), tokens, cards, etc., that may or may not be used in connection with or in furtherance of playing a game.

In any event, and still referring to FIGS. 2 and 3, at least one embodiment of the present invention includes an enclosure, generally referenced as 20, such as a box, that defines an interior area 25. In the embodiment shown, the enclosure 20 is defined by a bottom or base 22 and a removable lid 24, such that the lid 24 is completely removable or at least partially removable from the base 22 in order to expose the interior area 25 and the contents contained therein. More specifically, the lid 24 of the illustrated embodiment frictionally engages the base 24 or otherwise connects to the base 24 via cooperating edges or lips extending around the base 24 and the lid 22. In this manner, the lid 24 can be manually pressed onto the top edge of the base 24 in order to connect the lid to the base and form the enclosure. Similarly, the lid 24 can be manually pulled from the base 24 in order to separate the lid 24 and base 22, thereby exposing the interior area 25.

In other embodiments, however, the enclosure 20 may be constructed in other forms or manners such that access to the interior portion is accomplished in a different manner. For example, the lid 24 may be slidably connected to the base 24 and either fully or partially removable therefrom. Additionally, the lid 24 may be movably or pivotally connected to the base 22, e.g., via one or more hinges or other like features. Other enclosures defining an interior portion are contemplated within the full spirit and scope of the present invention.

It should be noted, however, that, in many embodiments or implementations, the lid 24 and the base 22 form a tight (e.g., an air tight or substantially air tight) seal preventing or substantially restricting the flow of air from escaping from the interior area 25 thereof, while the lid 24 enclosing the interior area 25. The tight seal facilitates the retention of the aroma or fragrance, as described herein, which thereby facilitates the infusion or application of the fragrance to the one or more dice or other items stored therein.

Furthermore, the example illustrated in FIGS. 1, 2 and 3 shows an enclosure 20 with a rectangular horizontal cross-section or a rectangular foot print, however, it should be apparent that the enclosure 20 as described herein can be in the form of other shapes and sizes and still fall within the full spirit and scope of the present invention.

Moreover, still referring to FIGS. 2 and 3, the container 10 of at least one embodiment includes a fragrance diffuser 30 disposed within the interior area 25 of the enclosure. In particular, the fragrance diffuser 30 of at least one embodiment is or operates as an evaporative fragrance diffuser. More specifically, the fragrance source 7, such as a fragrance or scented oil, may first be applied to at least a portion of the fragrance diffuser 30. The oil or other fragrance source 7 will then at least partially evaporate and disperse or permeate throughout the diffuser 30 and/or through the container or enclosure 20 thereof. In the embodiment shown, the oil or other fragrance source 7 will naturally evaporate from the fragrance diffuser 7, for example, without the aid or assistance from a fan or other like device. In other embodiments, however, it is contemplated that one or more fans can be incorporated into the container 10 or enclosure 20 to facilitate the evaporative process of the oil or other fragrance source from the fragrance diffuser 30.

As just an example, the fragrance diffuser 30 of at least one embodiment is a porous or permeable pad or other like structure to which the fragrance source 7 or oil is applied. More specifically, the fragrance diffuser 30 may be manufactured or made of, but is certainly not limited to, polyester, wool, cellulose fiber, natural fiber, or any other fibrous or non-fibrous material that is capable of or otherwise structured and configured to operate as a fragrance diffuser and/or an evaporative fragrance diffuser as contemplated within the scope of the present invention.

Figure 4:
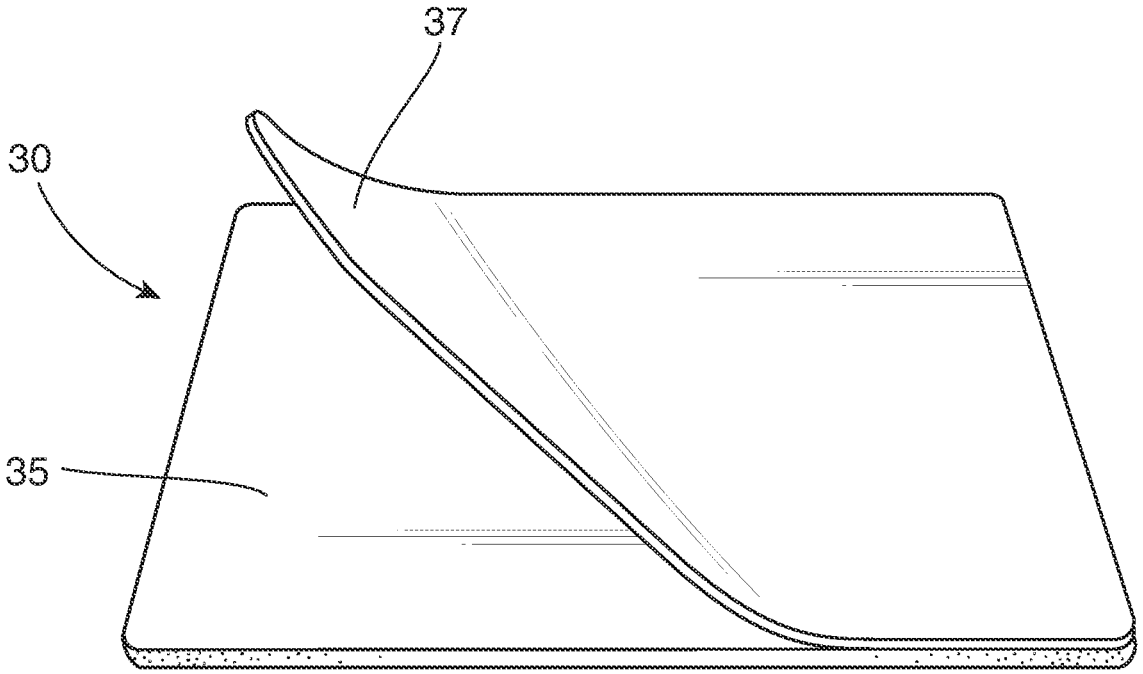
FIG. 4 is a bottom perspective view of the fragrance diffuser and the adhesive layer thereof as disclosed in accordance with at least one embodiment of the present invention.

Furthermore, with reference to the bottom view of an exemplary fragrance diffuser as shown in FIG. 4, in some embodiments, the fragrance diffuser 30 may include an adhesive undersurface, generally referenced as 35. More specifically, removal of a temporary protective layer 37 may expose an adhesive surface 35. In this manner, the fragrance diffuser 30 may be adhesively secured to an inside or bottom surface 23 (FIG. 2) of the enclosure 20. In other embodiments, the fragrance diffuser 30 may be secured to the enclosure in other manners (e.g., via clips, hooks, hook and loop fasteners, VELCRO, etc.), or the fragrance diffuser 30 may be floating or otherwise not attached or secured within the enclosure 20.

Additionally, in at least one embodiment, the fragrance diffuser 30 may include a shape and size that corresponds with or substantially corresponds with the shape and size of the interior area 25 of the enclosure 20. More specifically, in the embodiment shown, the interior area 25, and in particular, the bottom surface 23 thereof, includes a rectangular shape defined by interior enclosure walls 22*a-d*. In other words, the enclosure 20 includes an inner surface area defined by the interior enclosure walls 22*a-d*, which in the embodiment shown is rectangular in shape, although other shapes and sizes are contemplated. Furthermore, the fragrance diffuser 30 of at least one embodiment includes a corresponding shape and size such that a perimeter edge defined by edges 32*a-d* is sized to match, correspond with or otherwise fit within the inner surface area of the enclosure 20. In other words, each of the edges 32*a-d* of the fragrance diffuser 30 of at least one embodiment extend to or near a corresponding interior enclosure wall 22*a-d*. In other embodiments, the fragrance diffuser 30 may fit or be disposed within the interior area 25 in a different manner.

Furthermore, as shown in FIGS. 2, 3 and 4, for example, the fragrance diffuser 30 includes a generally planar or flat configuration. More specifically, in at least one embodiment, the bottom surface 37 (shown in FIG. 4) of the fragrance diffuser includes a flat planar surface that is able to lay flat onto the bottom surface 23 of the container 20. In other embodiments, the fragrance diffuser 30 and/or to bottom surface 23 of the container 20 may each include non-planar surfaces. Similarly, in the embodiment illustrated, the fragrance diffuser 30 includes a flat planar top surface (shown in FIGS. 2 and 3, for example). In this manner, as will be described herein, the bottom surface of the dice/item holder 40 is able to lay flat upon the top surface of the fragrance diffuser 30. Thus, the configuration or shape of top surface of the fragrance diffuser 30 may match or correspond with the bottom surface of the dice holder 40. In other embodiments, the top surface of the fragrance diffuser 30 and the bottom surface of the dice holder 40 may be non-planar.

In addition, as previously mentioned, at least one embodiment of the present invention also includes an item holder, which in the embodiment illustrated, is a dice holder generally referenced as 40. The item holder or dice holder 40 may include at least one or a plurality of retention openings, holes, recesses, or other like portions 45 which operate to receive, hold or retain one or more die/dice 5 or other item(s) therein. For instance, as shown in the embodiment illustrated in FIG. 2, the dice holder 40 includes a plurality of openings 45 or holes that extend completely through the dice holder 40 and which operate to hold or retain dice therein. In other embodiments, the dice holder 40 may include recesses or indents that do not extend all the way through the holder 40, or one or more extensions or protruding walls, pins, etc. that operate to receive dice or other items.

As shown, the opening(s) 45 may be formed of one or more various shapes and/or sizes in order to receive or correspond with the die/dice 5 (or other items) that may have different shapes and/or sizes. In other words, the openings 45 or other recesses or retention portions of the dice holder 40 may, in some embodiments, all be the same shape and size, although in other embodiments, as shown in FIG. 2, the openings 45 or other recesses or retention portions may be different shapes and sizes to accommodate differently shaped and sized items or dice 5.

In any event, the item holder or dice holder 40 of at least one embodiment is disposed or disposable within the interior portion 25 of the enclosure 20 and is fluidically arranged or fluidically communicative with the fragrance diffuser 20. More specifically, the fragrance or scented oil that evaporates from or through the fragrance diffuser 20, will flow or permeate within the enclosure, or will otherwise fluidically flow (e.g., via the flow of air) to the dice holder 40. In this manner, application of the fragrance source 7 to the fragrance diffuser 30 will cause the fragrance source 7 and/or vapor thereof to at least partially diffuse through the diffuser 30 and in some cases evaporate or diffuse within the enclosure, in order to infuse to, apply to or impart upon any one or more of the dice 5 (or other items) that are stored or retained within the item/dice holder 40.

In particular, as shown in FIG. 2, for example, the dice holder 40 of at least one embodiment includes a generally flat or planar pad or other like structure defined by perimeter edges 42*a-d*. As an example, the dice holder 40 may be formed of a foam pad with openings 45 disposed therein or there through, although other materials are contemplated and within the scope of the present invention. In some cases, a covering, such as but not limited to a velvet cover layer may cover the foam (or other) pad. Furthermore, the dice holder 40 of at least one embodiment includes a shape and size that corresponds with the shape and size of the enclosure 20. More specifically, the dice holder 40 may include perimeter edges 42*a-d* that match, correspond with or otherwise fit within the inner surface area of the enclosure 20. In other words, each of the edges 42*a-d* of the dice holder 40 of at least one embodiment extend to or near a corresponding interior enclosure wall 22*a-d*.

With reference to the exploded view of FIG. 3, the dice holder 40 may be layered or stacked on top of the fragrance diffuser 30. Specifically, in at least one embodiment, the fragrance diffuser 30 may be disposed within the interior area 20 of the enclosure 20 and in a substantially covering relation to the bottom interior surface 23 thereof. As described above, the fragrance diffuser 30 may be adhesively secured to the bottom surface 23. Still referring to FIG. 3, the dice holder 40 is then stacked or layered on top of the fragrance diffuser in a manner to substantially or completely cover the fragrance diffuser 30. It should be noted that the dice holder 40 may be loosely disposed within the enclosure and on top of the fragrance diffuser 30 in order to allow the fragrance oil vapor to effectively permeate the interior area 25 of the enclosure 20.

It should also be noted that, in at least one embodiment, prior to stacking or layering the dice holder 40 on top of the fragrance diffuser 30, the fragrance oil or other fragrance source 7 may be applied to at least a portion of the fragrance diffuser 30. More specifically, one or several drops of a scented oil or other fragrance source may be applied to a portion (e.g., a designated application portion, as described in accordance with at least one embodiment) of the fragrance diffuser 30. Then, with the fragrance source or oil applied to the diffuser 30, the dice holder 40 can be stacked within the enclosure 20.

In other embodiments, however, the fragrance oil may be applied to the fragrance diffuser 30 with the dice holder 40 in place. In other words, in some embodiments, at least a portion of the fragrance diffuser 30 may be accessible while the dice holder 40 is in place or stacked thereon such that the dice holder 40 may not need to be removed completely in order to apply the fragrance oil or other source to the diffuser 30.

Furthermore, in accordance with at least one embodiment of the present invention, with the dice holder 40 in place and stacked on top of the fragrance diffuser 30, the die/dice 5 or other item(s) may be secured, retained or disposed within the openings or other retention portions, and the lid 24 can be placed on top of the base 22 to secure the enclosure 20 in the closed position. While closed, the fragrance source 7 or oil will diffuse within the interior area 25 of the enclosure and impart upon or otherwise be applied to the dice 5 or other items therein.

Figure 5:
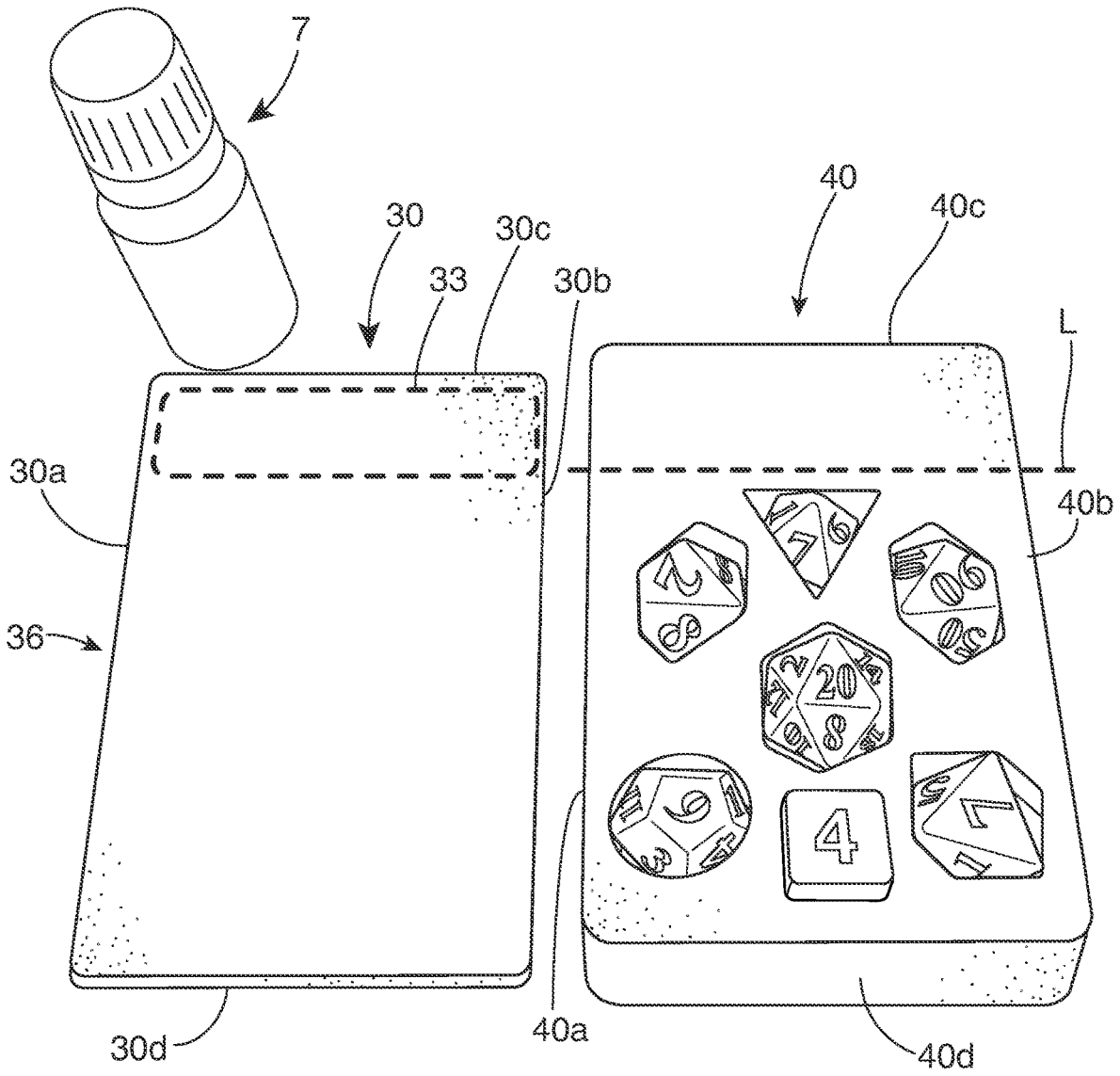
FIG. 5 is a side-by-side view of the fragrance diffuser and dice holder as disclosed in accordance with at least one embodiment of the present invention, along with exemplary dice and an exemplary bottle of scented oil.

Referring now to FIG. 5, the fragrance diffuser 30 of at least one embodiment includes a designated application portion, referenced as 33, upon which or to which the fragrance oil or other fragrance source is applied. In at least one embodiment, as shown in FIG. 5, the application portion 33 of the fragrance diffuser 30 is a designated area defined on one end of the diffuser 30, although other locations are contemplated with other embodiments. More specifically, as shown, the designated application portion 33 may extend from one of the end edges 30*c* and between opposing longitudinal edges 30*a*, 30*b* thereby occupying and end of the diffuser 30.

Furthermore, still referring to FIG. 5, the designated application portion 33 of at least one embodiment is offset from or otherwise not aligned with the plurality of dice retention openings or portions 45 of the dice holder 40. In other words, when the dice holder 40 is vertically stacked or layered on top of the diffuser 30 (e.g., as shown in FIG. 3), the designated application portion of the diffuser is offset from each of the dice retention openings 45, or otherwise not vertically aligned with any of the dice retention openings 45.

It should also be noted that the designated application portion 33 may be marked directly on the fragrance diffuser 30 via one or more demarcations, indicia or marking such as, but not limited to, one or more lines, boxes, instructions, colors, shading, etc. In other cases, however, there may not be any markings, indicia or demarcations that physically or visually identify the designated application portion 33.

Accordingly, with the dice retention openings 45 (and therefore the dice retained therein) offset from or not aligned with the designated application portion 33 where the fragrance oil is applied, the dice 5 are not in direct contact with oil or other fragrance source. The offset or non-aligned relation allows the fragrance to be applied to the dice via diffusion, vapor and/or at least partial evaporation of the fragrance oil, but prevents or minimizes the dice from becoming oily, which may occur in the event of direct contact with the oil applied to the diffuser.

Thus, as provided herein, the fragrance oil may be applied directly to the diffuser only within the designated application portion referenced as 33 in FIG. 5. The dice holder 40 is constructed in a manner such that the retention openings or portions 45 are offset from the application portion 33 when the dice holder 40 is vertically stacked or layered upon the diffuser 30. As an example, with reference to FIG. 5, line L represents a delineation that correspond with the application portion 33 such that no retention openings or portions are located on the dice holder 40 that would vertically align with the application portion 33, for example, when stacked or installed within the container.

Accordingly, with the fragrance oil or other fragrance source applied to the application portion 33 of the diffuser, in at least one embodiment, the oil may diffuse through the porous pad of the diffuser 30, for example, through the remaining portion 36 thereof. The oil may also at least partially evaporate or permeate throughout the interior area 25 of the enclosure, particularly with the lid 24 closed and secured to the base 22. This allows the fragrance or vapor caused thereby to impart upon, apply to or infuse to the dice 5 or other item(s) disposed within the enclosure.

Referring now to FIGS. 6 and 7A-7C, the present invention also includes a method 100 of applying a fragrance to at least one dice or other item. In particular, the method 100 of at least one embodiment includes a plurality of steps or operations that use the container 10 described in accordance with other embodiments herein. For example, as shown at 102 in the high level flow chart of FIG. 6, the method 100 includes applying a fragrance or scented oil (or other fragrance source) to the fragrance diffuser 30. More specifically, as described herein, the diffuser 30 may have a designated application portion 33 to which the fragrance oil is applied. In such an embodiment, the user may apply one or more drops (or other amounts, as desired) of the oil or other fragrance source 7 to the application portion 33 of the fragrance diffuser 30.

Figure 7A:
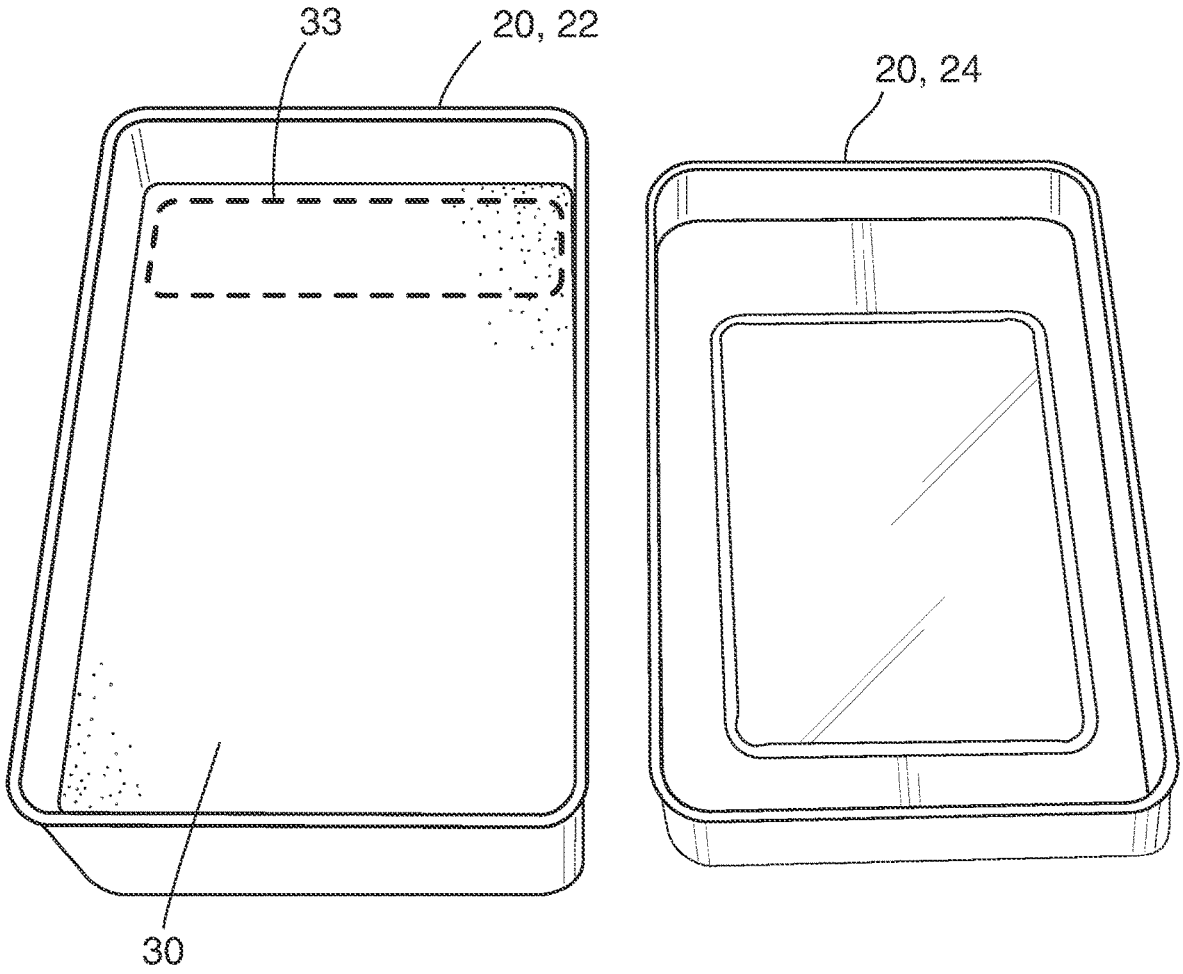
FIG. 7A is a top perspective view of the enclosure with the lid separated, exposing the fragrance diffuser disposed therein, as disclosed in accordance with at least one embodiment of the present invention.

As described herein, the fragrance diffuser 30 may be disposed within an enclosure 20 or otherwise within an interior area of an enclosure 20 or container, as shown for example in FIG. 7A.

Referring again to FIG. 6, as shown at 104, the method 100 further includes layering or stacking a dice holder 40 on top of the fragrance diffuser 30 in a manner or in a position such that the dice retention portions 45 thereof are offset from the application portion 33 of the diffuser 30. FIG. 7B illustrates the dice holder 40 disposed in an overlying relation with the diffuser (not shown in FIG. 7B). Each of the plurality of dice retention openings or portions 45 are offset from, not aligned with, or otherwise not directly above the application portion 33 to which the fragrance oil was applied.

Figure 6:
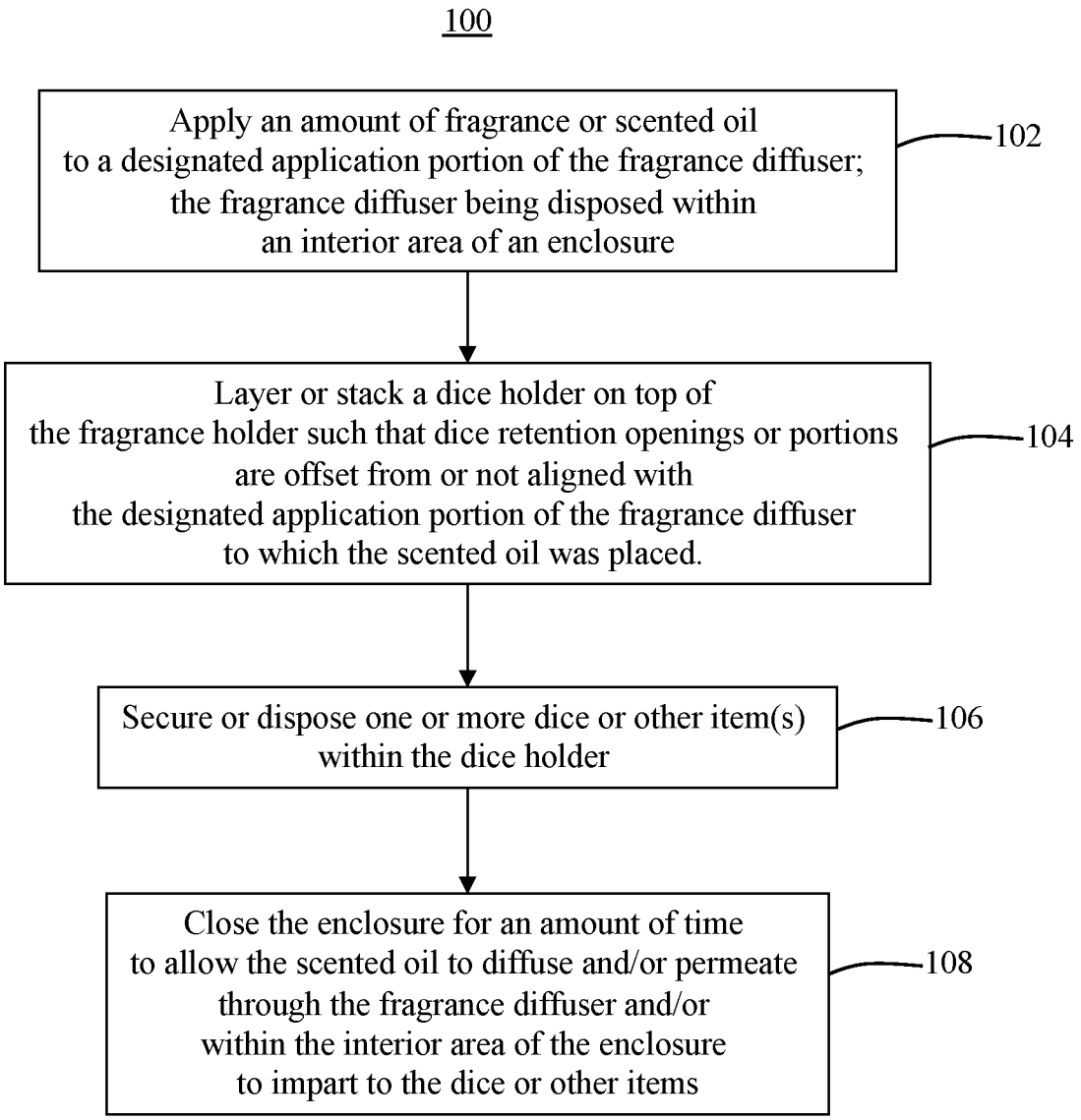
FIG. 6 is a high level flow chart of the method for infusing one or more dice with a fragrance, as disclosed in accordance with at least one embodiment of the present invention.
Figure 7B:
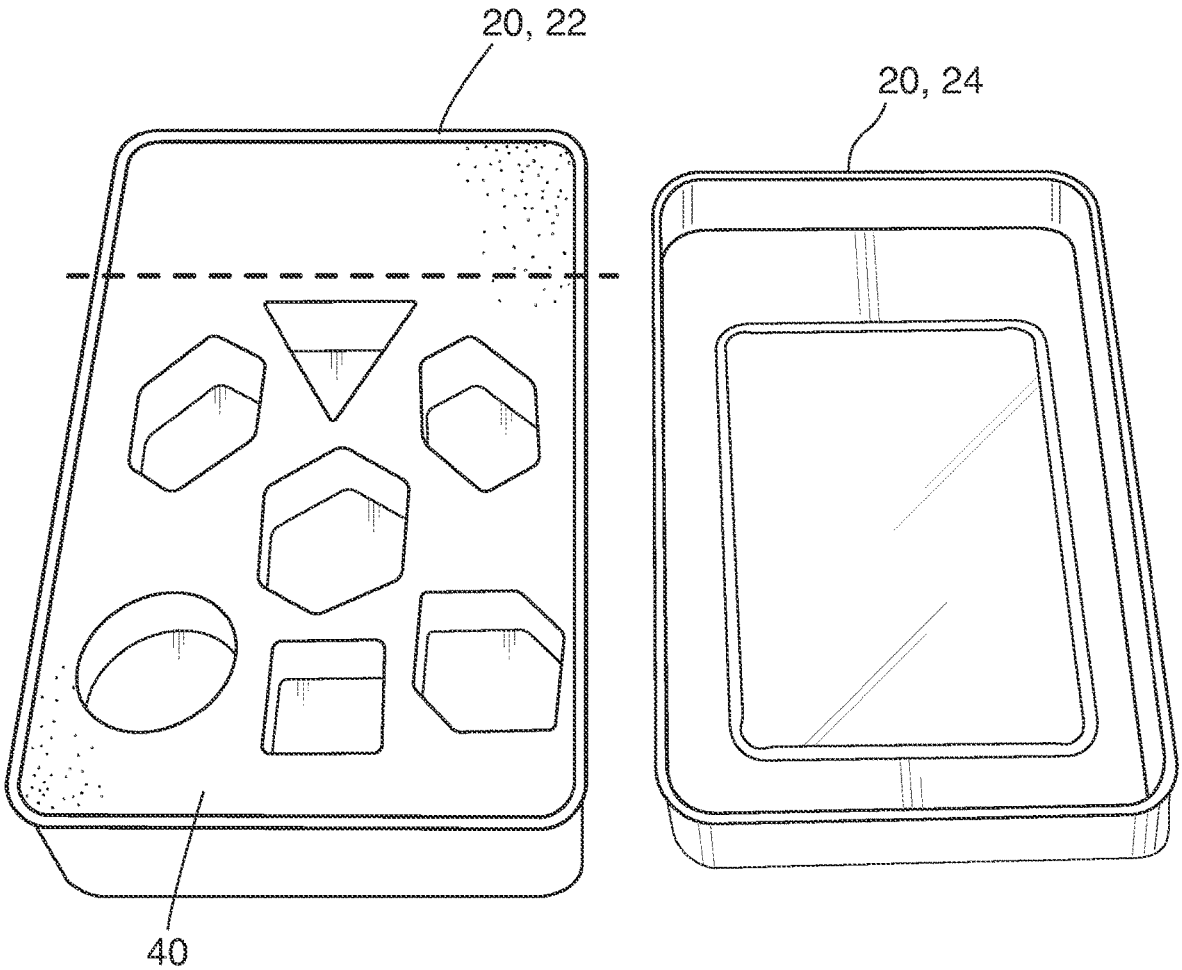
FIG. 7B is a top perspective view of the enclosure with the lid separated, exposing the dice holder disposed therein, as disclosed in accordance with at least one embodiment of the present invention.
Figure 7C:
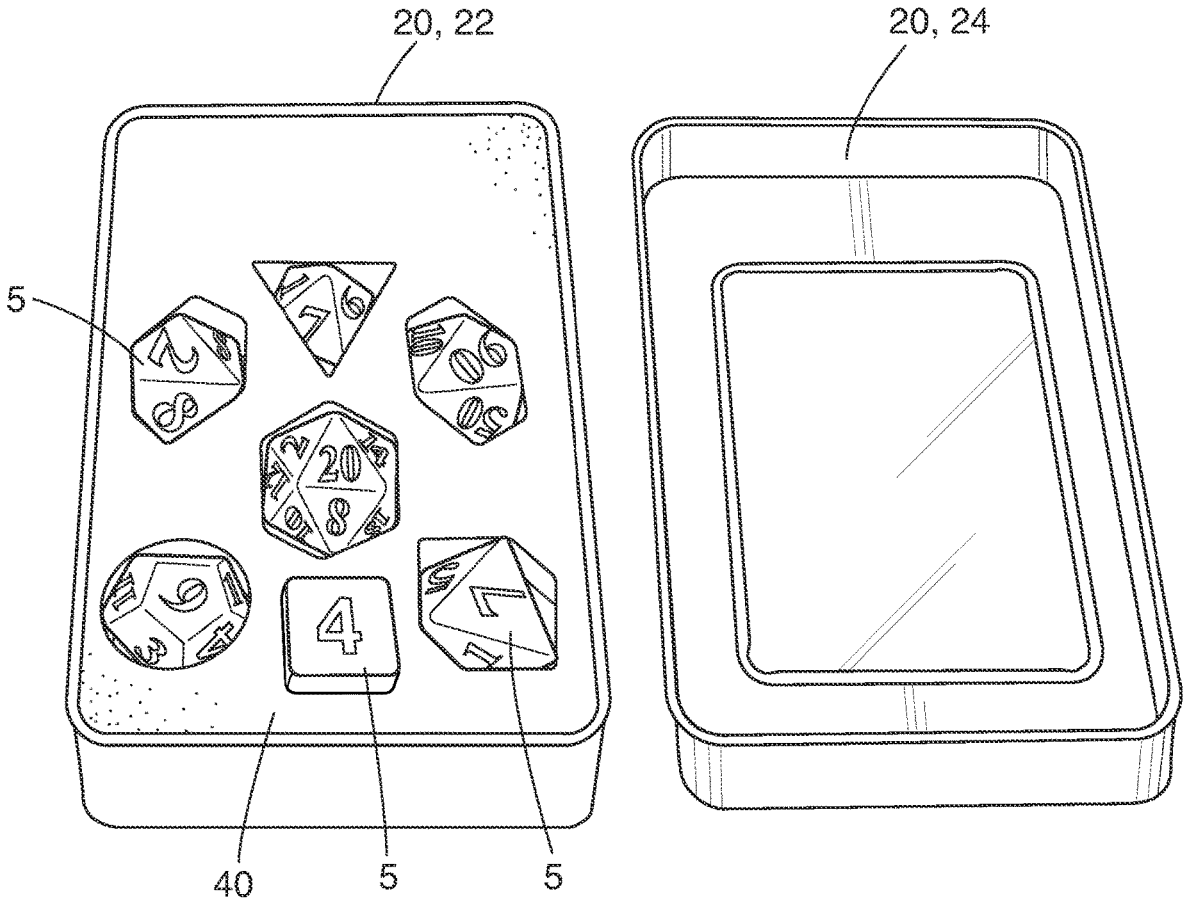
FIG. 7C is a top perspective view of the enclosure with the lid separated, exposing the dice holder disposed therein and exemplary dice retained thereby, as disclosed in accordance with at least one embodiment of the present invention.

Next, as shown at 106 in FIG. 6 and as illustrated in FIG. 7C, the dice 5 or other item(s) are then placed or disposed within the retention portions or openings 45 of the dice holder 40. Some or all of the openings 45 may be filled, as desired by the user.

As shown at 108 in FIG. 6, and with reference again to FIG. 1, the enclosure 20 is closed, for example, by securing the lid 24 onto the base 22. This will retain the fragrance diffuser 30, the dice holder and the dice 5 within the enclosure allowing the scented oil or other fragrance source 7 to diffuse and/or at least partially evaporate through the diffuser and/or within the enclosure. For example, in at least one embodiment, the diffuser 30 includes a porous or permeable pad through which the oil or vapor from the oil can diffuse. Accordingly, in at least one embodiment, with the fragrance or scented oil applied to the designated application portion 33, the oil is able to diffuse through the remaining or other portions of the pad or diffuser, referenced as 36. Furthermore, the scented oil may at least partially evaporate or vaporize and permeate throughout the interior area of the enclosure 20. Doing so, will impart, apply or infuse the fragrance (through the vapor or at least partially evaporated oil) to the dice or other items disposed therein.

As described herein, with the dice offset from the designated application portion, the dice are not directly exposed to the oil, itself, and therefore, do not get oily or overly oily throughout the diffusion process.

It should also be noted, and apparent, that adding more fragrance oil to the diffuser and/or allowing the dice to remain within the enclosure 20 with the fragrance oil and diffuser for longer periods of time can impact or otherwise increase the amount of fragrance that is ultimately imparted to the dice. The user can thus experiment according to his or her preferences in terms of what fragrance source to use, how much fragrance source to use, and how long to diffuse the dice within the container.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

What is claimed is:

1. A fragrance infusing dice container, comprising:

an enclosure defining an interior area, a fragrance diffuser disposed within said interior area of said enclosure, and a dice holder disposed within said interior area of said enclosure, said dice holder comprising at least one dice retention opening sized to receive and retain at least one dice therein, the at least one dice being fluidically arranged with said fragrance diffuser such that application of a scented oil to at least a portion of said fragrance diffuser causes the scented oil to at least partially evaporate within said enclosure and impart upon the at least one dice disposed within said dice holder.

2. The fragrance infusing dice container as recited in claim 1 wherein said enclosure comprises a bottom base and a removable lid, wherein said fragrance diffuser and said dice holder are disposed within said bottom base.

3. The fragrance infusing dice container as recited in claim 2 wherein said fragrance diffuser comprises an application portion upon which the scented oil is applied, said application portion being offset from said at least one dice retention opening.

4. The fragrance infusing dice container as recited in claim 3 wherein said dice holder comprises a plurality of dice retention openings.

5. The fragrance infusing dice container as recited in claim 4 wherein said application portion of said fragrance diffuser is offset from each of said plurality of dice retention openings.

6. The fragrance infusing dice container as recited in claim 5 wherein said dice holder is layered on top of said fragrance diffuser within said interior area of said enclosure.

7. The fragrance infusing dice container as recited in claim 6 wherein said fragrance diffuser is adhesively secured to said bottom base of said enclosure.

8. The fragrance infusing dice container as recited in claim 7 wherein said fragrance diffuser comprises an air permeable wool pad.

9. The fragrance infusing dice container as recited in claim 8 wherein said fragrance diffuser comprises a perimeter edge sized to substantially match an inner surface area of said enclosure.

10. The fragrance infusing dice container as recited in claim 9 wherein said dice holder comprises a perimeter edge sized to substantially match said inner surface area of said enclosure.

11. A fragrance infusing dice container, comprising:

an enclosure defining an interior area, said enclosure comprising a base and a removable lid, an evaporative fragrance diffuser disposed within said interior area of said enclosure, a dice holder disposed within said interior portion of said enclosure, said dice holder comprising a plurality of dice retention portions each sized to at least partially receive a dice therein, each of said plurality of dice retention portions being arranged within said enclosure relative to said evaporative fragrance diffuser such that application of a scented oil to at least an application portion of said evaporative fragrance diffuser causes the scented oil to at least partially diffuse and flow to said plurality of dice retention portions, and wherein said application portion of said evaporative fragrance diffuser is offset from each of said plurality of dice retention openings of said dice holder.

12. The fragrance infusing dice container as recited in claim 11 wherein said application portion of said evaporative fragrance diffuser is vertically offset from each of said plurality of dice retention openings of said dice holder.

13. The fragrance infusing dice container as recited in claim 12 wherein said dice holder is stacked on top of said fragrance diffuser within said interior area of said enclosure.

14. The fragrance infusing dice container as recited in claim 13 wherein said evaporative fragrance diffuser comprises a pad secured within said bottom base of said enclosure, wherein said application portion is disposed at one end of said pad.

15. The fragrance infusing dice container as recited in claim 14 wherein each of said plurality of dice retention portions of said dice holder are non-aligned with said application portion of said evaporative fragrance diffuser.

* * * * *